US005520319A

United States Patent [19]

Mayr et al.

[11] Patent Number: 5,520,319

[45] Date of Patent: May 28, 1996

[54] TOOL FOR MANUALLY ANCHORING EXPANSION DOWELS

[75] Inventors: Franz-Paul Mayr, Hechenwang; Franz Popp, Buchloe, both of Germany

[73] Assignee: Hilti Aktiengesellschaft, Fürstentum, Liechtenstein

[21] Appl. No.: 269,458

[22] Filed: Jun. 30, 1994

[30] Foreign Application Priority Data

Jul. 3, 1993 [DE] Germany ..... 43 22 233.1

[51] Int. Cl.[6] ..... B25B 27/14

[52] U.S. Cl. ..... 227/147

[58] Field of Search ..... 227/140, 147, 227/148, 156; 173/29, 132, 128; 81/44, 487, 321, 427

[56] References Cited

U.S. PATENT DOCUMENTS

| | | | |
|---|---|---|---|
| 3,060,441 | 8/1960 | Henning | 227/147 |
| 3,695,499 | 10/1972 | Taylor | 227/147 X |
| 4,403,725 | 9/1983 | Lawrence | 227/147 |
| 4,709,841 | 12/1987 | Wollar | 227/147 X |
| 4,978,047 | 12/1990 | Chen | 227/147 |

*Primary Examiner*—Scott A. Smith
*Assistant Examiner*—Jay A. Stelacone
*Attorney, Agent, or Firm*—Anderson Kill Olick & Oshinsky

[57] ABSTRACT

A tool for anchoring expansion dowels has a handle (1) with two receiving mounts (2, 10) into which a setting drift (8, 13) can be fixed. Each receiving mount (2, 10) has an axis corresponding to the axis of the setting drift (8, 13). The axes of the receiving mounts (2, 10) are disposed at an angle of 90° relative to one another. Flexural elements exert a prestress on the fixed setting drift (8, 13).

7 Claims, 1 Drawing Sheet

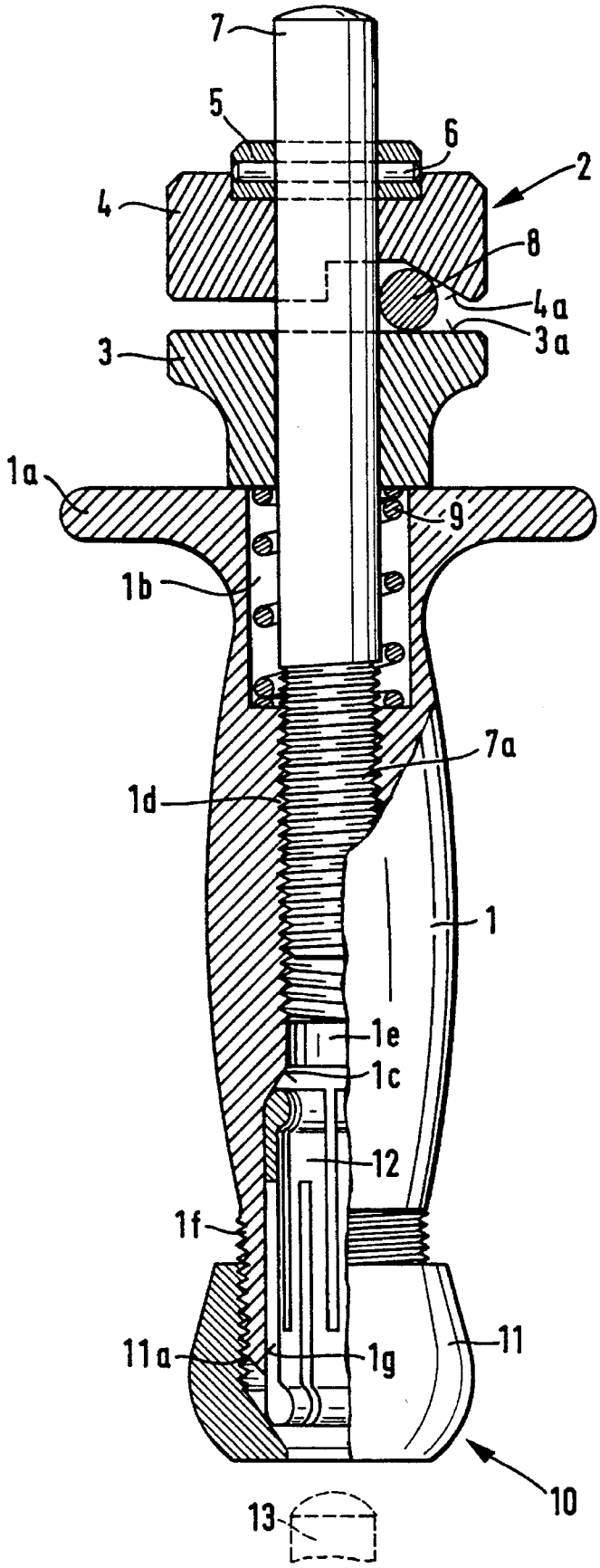
7
5
6
2
4
8
4a
3a
3
1a
9
1b
7a
1d
1
1e
1c
12
1f
11a
1g
11
10
13

TOOL FOR MANUALLY ANCHORING EXPANSION DOWELS

BACKGROUND OF THE INVENTION

The present invention is directed to a tool for manually anchoring expansion dowels by means of a setting drift or ram secured in a handle.

Expansion dowels formed of an expansion sleeve and expanding member are driven or anchored by displacing either the expanding member relative to the expansion sleeve or the expansion sleeve relative to the expanding member. Such relative displacement, serving to anchor the expansion dowel, can be performed mechanically or, as is mainly the case, manually by means of a hammer.

There is a well-known tool used for manually anchoring an expansion dowel. This tool includes a setting drift or ram which contacts the part of the expansion dowel to be displaced.

Such a tool for manually anchoring expansion dowels is disclosed in DE-OS 31 11 241. This known tool has a handle with the setting drift originally connected to it. In this tool the handle and setting drift are in axial alignment. With such a mounting arrangement of the setting drift there are certain locations where it is difficult to apply hammer blows and in certain extreme cases such a tool cannot be used.

In this known tool a setting drift of a specific size must be used, as a result there is another disadvantage in that for each diameter of an expansion dowel, a special tool with a correspondingly matched setting drift must be used.

SUMMARY OF THE INVENTION

The primary object of the present invention is to provide a tool for manually anchoring expansion dowels distinguished by a universal usability as well as a possibility for use in difficult to reach locations.

In accordance with the present invention, the tool has a handle with two receiving mounts for the setting drift with the axes of the receiving mounts arranged at an angle to one another.

Since the tool embodying the present invention has two receiving mounts with the receiving opening of the these mounts disposed at an angle to one another, there is the possibility that the axial direction of the setting drift to be inserted into a receiving mount can be changed while maintaining the direction of the handle. This arrangement permits the change in the direction of the hammer blows relative to the direction of the handle. Accordingly, the tool can be adapted to a particular case, by inserting the setting drift into the receiving mount more favorably positioned with regard to the particular case. In particular, there is the possibility of equipping the tool with two setting drifts, wherein the setting drifts can have different dimensions, whereby different dimensions of expansion dowels can be anchored.

In a preferred embodiment, the axes of the receiving openings are arranged at an angle of 90° to one another. In actual practice it has been demonstrated that in the greatest number of cases the anchoring of the expansion dowels can be effected with such an angular arrangement of the receiving openings in the receiving mounts.

To enable the use of different sized setting drifts in the receiving openings, preferably the inside cross-section of the opening is changeable. This changeability of the cross-section has essentially two functions. Initially it serves, as has been pointed out, for adapting to differently sized setting drifts and, secondly, for affording the retention function of the setting drifts by means of a frictionally locked clamping.

In a preferred arrangement, at least one of the receiving mounts is configured similar to a clamping pliers. In this arrangement it would be expedient to use a conventional type of clamping pliers where flexural elements are actuated by a union nut. In a preferred manner elements are used which act under spring pressure towards the center or axis of the receiving opening to afford self-locking of the setting drift inserted in the opening. Such an arrangement affords a certain security against loss, for instance, if the tool is used at an elevated position such as on scaffolding or the like.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there is illustrated and described a preferred embodiment of the invention.

BRIEF DESCRIPTION OF THE DRAWING

The drawing is an elevational view, partly in section, of a tool embodying the present invention.

DETAILED DESCRIPTION OF THE INVENTION

As shown in the drawing, the tool for anchoring expansion dowels includes an elongated handle having a first end, the upper end as viewed in the drawing, with a flange-like blow protector 1*a* formed monolithically with the handle. The blow protector 1*a* projects radially outwardly from the handle for reducing the possibility of injury to the hand when hammer blows are applied to an impact or percussion rod 7 extending axially out of the handle 1. Handle 1 has a central throughbore 1*e* extending from its upper first end to its lower second end as viewed in the drawing. The throughbore 1*e* has an axially extending inside thread 1*d* and two axially extending and spaced widened sections 1*b*, 1*g* with one widened section 1*b* extending from the upper first end and the other widened section 1*g* extending from the lower end of the handle 1. Further an outside thread if is located on the handle adjacent its second end. Two receiving mounts 2, 10 are located on the handle with a first receiving mount 10 located in the second end region of the handle 1, that is the lower end as viewed in the drawing. The second end region of the throughbore 1*e* contains a radially compressible twin cone clamping sleeve 12. The handle 1 has the outside thread if in the second end region and it cooperates with an inside thread 11*a* of a tightening nut 11. When the tightening nut 11 is turned relative to the handle 1, an axial displacement of the tightening nut takes place relative to the handle with a tightening or loosening of the twin cone clamping sleeve 12. The second widened section 1*g* along with the tightening nut 11 have conical surfaces 1*c*, 11*a* which coact with conically-shaped end surfaces on the opposite ends of the twin cone clamping sleeve 12. As can be noted in the drawing, the clamping sleeve 12 has axially extending slots extending from opposite ends for affording a flexural effect for the sleeve.

At the lower end of the handle 1, an end portion of a setting drift 13 is shown in phantom and can be inserted into the receiving mount 10 where a radial clamping or gripping of the twin cone clamping sleeve 12 about the setting drift is possible.

The second receiving mount 2 is located at the first end of the handle 1 and is formed essentially by two circular clamping disks 3, 4. Clamping disk 4, in combination with clamping disk 3 forms a receiving opening for a setting drift 8. Note the downwardly facing surface 4*a* of clamping disk 4 is shaped to receive the setting drift. The clamping disk 4 is non-rotatably connected with the percussion rod 7. The non-rotatable connection is afforded by a locking pin 6 extending through the rod 7 and the pin is connected to a disk 5 having an irregular outside contour and encircling the percussion rod 7. The irregular outside contour of the disk 5 matches an irregular contour of a recess in the upper surface of the clamping disk 4. The recess is located in the opposite surface of the disk 4 from the receiving opening.

An axially extending part of the percussion rod 7 has an outside thread 7*a* in threaded engagement with the inside thread 1*d* in the handle 1. By turning the handle 1 relative to the percussion rod 7, an axial displacement of the clamping disk 4 non-rotatably connected to the percussion rod 7, takes place. The other clamping disk 3, located closer to the blow protector 1*a*, is shaped to be rotatable and axially displaceable on the percussion rod 7. In the first widened section 1*b* of the central throughbore 1*e* in the handle 1 adjacent the first end of the handle, there is a compression spring 9 which presses against the clamping disk 3 in addition to being freely rotatable on the rod 7. The setting drift 8 located between the upper end face 3*a* of the clamping disk 3 and the receiving opening formed by the clamping disk 4 non-rotatably connected with the percussion rod 7 is subjected to prestress even if the second receiving mount 2 is in the unstressed or relaxed state.

Each of the receiving mounts 2, 10 disposed at right angles to one another can hold a setting drift 8, 13. The way the tool is held depends on the accessibility to the location of the expansion dowel. As an example, if an expansion dowel is to be anchored into a floor or generally horizontal base surface, the tool handle 1 is held at an angle of 90° to the floor or base surface. To anchor the expansion dowel, blows are directed against the percussion rod 7 in axial alignment with the setting drift 13 at least partially inserted into the handle, and the drift affords the anchoring of the expansion dowel.

If an expansion dowel is to be set in a vertical wall or surface about eye level, the axis of the handle 1 is held essentially parallel to the wall or surface. In this position, however, blows are not directed against the percussion rod 7, instead the blows are directed against the end of the setting drift 8 opposite the end in contact with the expansion dowel. In this anchoring arrangement the setting drift 8 is disposed perpendicularly to the axis of the handle 1.

While a specific embodiment of the invention has been shown and described in detail to illustrate the inventive principles, it will be understood that the invention may be embodied otherwise without departing from said principles.

We claim:

1. A tool for manually anchoring expansion dowels comprises an axially extending handle (1) and a setting drift (8, 13) having an axis and being removably mounted on the handle (1) for setting the expansion dowel, wherein the improvement comprises two receiving mounts (2, 10) located on said handle and each having a receiving opening for receiving the setting drift, each said receiving opening has an axis arranged to align with the axis of the setting drift (8, 13) inserted therein, and the axes of said receiving openings are disposed at an angle to one another, and the axes of said receiving openings form an angle of 90° relative to one another.

2. A tool, as set forth in claim 1, wherein an inside cross-section of said receiving openings extending transversely of the axis thereof is variable.

3. A tool, as set forth in claim 2, wherein at least one of said receiving mounts (2) is shaped in the manner of a clamping pliers (12).

4. A tool, as set forth in claim 3, wherein said clamping pliers (12) comprises an element acting under spring pressure towards the axis of the receiving opening of said at least one of said receiving mounts.

5. A tool, as set forth in claim 3, wherein said handle has a first end and a second end, said handle (1) has an axially elongated throughbore (1*e*) extending between the first and second end thereof, said throughbore (1*e*) has a first widened section (1*b*) adjacent said first end and a second widened section adjacent said second end with a threaded section (1*d*) located between said first and second widened sections, a percussion rod (7) arranged in threaded engagement with said threaded section (1*d*) and extending axially through said first widened section (1*b*), a radially compressible twin cone clamping sleeve (12) located within said second widened section (1*g*), a tightening nut (11) fitted around the second end of said handle (1) and enclosing said second widened section (1*g*), and means on said tightening nut (11) on an inside surface of said second widened section (1*g*) and on opposite ends of said sleeve (12) for cooperating in clamping said setting drift (13) within said sleeve (12).

6. A tool, as set forth in claim 2, wherein said handle (1) has an axially elongated throughbore (1*e*), one of said receiving mounts (2) comprises a pair of clamping disks (3, 4) located at one end of said handle (1), said clamping disks (3, 4) having facing surfaces (3*a*, 4*a*) with at least one of the surfaces (4*a*) shaped for forming, in combination with the surface of the other said disk, one of said receiving openings, a percussion rod (7) having an axis and extending in the axial direction, said percussion rod rotatably fixed in said throughbore (1*e*) and extending axially through said disks (3, 4), said receiving opening between said disks (3, 4) having an axis extending perpendicularly to the axis of said percussion rod (7).

7. A tool, as set forth in claim 6, wherein said handle (1) has a widened section (1*b*) in said throughbore extending radially outwardly from said percussion rod (7) and located adjacent said disks (3, 4), and a compression spring (9) located in said widened section (1*b*) and acting on one of said disks (3) and pressing said one of said disks (3) toward the other said disk (4).

* * * * *